US011484056B2

(12) United States Patent
Cieslikowski et al.

(10) Patent No.: US 11,484,056 B2
(45) Date of Patent: Nov. 1, 2022

(54) APPARATUS AND METHOD FOR PROCESSING ROD-LIKE ARTICLES OF THE TOBACCO INDUSTRY

(71) Applicant: International Tobacco Machinery Poland Sp. z o. o., Radom (PL)

(72) Inventors: Bartosz Cieslikowski, Radom (PL); Leszek Sikora, Radom (PL)

(73) Assignee: International Tobacco Machinery Poland Sp. z o. o., Radom (PL)

( * ) Notice: Subject to any disclaimer, the term of this patent is extended or adjusted under 35 U.S.C. 154(b) by 81 days.

(21) Appl. No.: 17/247,740

(22) Filed: Dec. 21, 2020

(65) Prior Publication Data

US 2021/0186084 A1 Jun. 24, 2021

(30) Foreign Application Priority Data

Dec. 20, 2019 (EP) ..... 19219146
Jan. 13, 2020 (PL) ..... 432543

(51) Int. Cl.
*A24C 5/32* (2006.01)
*A24C 5/33* (2006.01)

(52) U.S. Cl.
CPC ..... *A24C 5/327* (2013.01); *A24C 5/33* (2013.01)

(58) Field of Classification Search
CPC ..... A24C 5/0254; A24C 5/12; A24C 5/28; A24C 5/327
See application file for complete search history.

(56) References Cited

U.S. PATENT DOCUMENTS

2005/0217447 A1 10/2005 Hollandsworth

FOREIGN PATENT DOCUMENTS

| | | | |
|---|---|---|---|
| DE | 3334572 | A1 | 4/1984 |
| EP | 2713784 | B1 | 11/2016 |
| WO | 20140123435 | A2 | 8/2014 |

OTHER PUBLICATIONS

European Search Report in Application No. EP 19219146 dated Jun. 24, 2020.

*Primary Examiner* — Eric Yaary
(74) *Attorney, Agent, or Firm* — Oppedahl Patent Firm LLC

(57) ABSTRACT

The object of the application is an apparatus for processing rod-like articles of the tobacco industry wherein the rod-like articles are conveyed in flutes of a conveyor along a path of movement transverse to the axis of the rod-like article with a pair (6) of circular knives (6A, 6B) adjacent to each other, whereas the axes of rotation (Z, Z') of the circular knives are situated on two sides of the path of movement (P), characterized in that the path of movement (P) passes through an area (6C) of overlapping of the adjacent circular knives (6A, 6B), whereas in the pair (6) of the adjacent circular knives (6A, 6B) one circular knife (6A) is situated above the carrier surface (2A, 2A') of the conveyor (2, 2'), whereas the other circular knife (6B) is situated beneath the carrier surface (2A, 2A') of the conveyor (2, 2'). The object of the application is also a method for processing rod-like articles (1) of the tobacco industry.

13 Claims, 9 Drawing Sheets

APPARATUS AND METHOD FOR PROCESSING ROD-LIKE ARTICLES OF THE TOBACCO INDUSTRY

The object of the invention is an apparatus and a method for processing rod-like articles of the tobacco industry.

Products and semi-finished products of the tobacco industry such as finished cigarettes, cigarillos, tobacco rods, filter rods are subjected to various operations in the production process. The products and semi-finished products are filled with tobacco, filter materials and various materials having auxiliary functions, whereas the products and semi-finished products are cut in the production process. There is a need to develop processing apparatuses and processes which guarantee a high quality of all components of products and semi-finished products. An example of the semi-finished product which causes problems during the cutting process is a rod containing tobacco or tobacco foil inside which a metal insert in the form of a plate which is cut of a metal strip is situated. The forces generated when cutting such metal insert as well as any other insert in other products depend on the angular position taken by a product, generally a rod-like article, relative to a circular knife commonly used to cut such articles. During the cutting process, the insert may change its position within the article, and in addition it may deform, whereas the deformation is concerned over the entire length of the insert as well as the cutting point. Only the ends of the article are subject to a visual assessment, whereas it is necessary to X-ray the rod in order to assess the deformation inside the article. A problem for the manufacturer is the wear of circular knives which increases when the position of the insert is completely random, as a result of which the knives may be loaded unequally and, in addition, to an extent which is higher than intended by the knife manufacturer.

Apparatuses for cutting a rod-like article into two or more parts are known in the prior art. The document DE3334572A1 discloses an apparatus for cutting a rod-like article into two parts by means of a circular knife, whereas the rod-like article is conveyed in a direction which is perpendicular to its axis in a flute in which it is held by means of vacuum.

The patent EP2713784B1 discloses an apparatus for cutting rod-like articles into multiple parts wherein the rod-like articles are conveyed in flutes of a drum conveyor along a path of movement situated parallel to the circumferential surface of the drum conveyor, whereas circular knives are attached to several shafts, and the axes of such shafts are situated parallel to the axes of rod-like articles being conveyed and cut.

The object of the invention is an apparatus for processing tobacco industry's rod-like articles wherein the rod-like articles are conveyed in flutes of a conveyor along a path of movement transverse to the axis of the rod-like article provided with a pair of circular knives adjacent to each other, whereas the axes of rotation of the circular knives are situated on two sides of the path of movement. The apparatus is characterized in that the path of movement passes through an area of overlapping of the adjacent circular knives, whereas in the pair of the adjacent circular knives one circular knife is situated above the carrier surface of the conveyor, whereas the other circular knife is situated beneath the carrier surface of the conveyor.

The apparatus according to the invention wherein in the pair of the adjacent circular knives the cutting edge of the circular knife is formed by the lateral surface of the circular knife and the circumferential conical surface.

The apparatus according to the invention wherein in the pair of the adjacent circular knives the cutting edge of one circular knife is situated adjacently to the lateral surface of the other circular knife.

The apparatus according to the invention wherein the apparatus is further provided with at least one circular knife not adjacent to another circular knife for cutting the rod-like article, whereas the axis of rotation of the circular knife is parallel to the axis of the rod-like article being cut, and the cutting surface of the circular knife not adjacent to another circular knife is formed by two conical surfaces.

The apparatus according to the invention wherein on the path of movement of the rod-like articles as first in the direction of movement of the rod-like articles there is situated the pair of the circular knives adjacent to each other, as next there are situated the circular knives not adjacent to other circular knives.

According to the invention in direction of movement of the rod-like articles there may be situated a pair of circular knives adjacent to each other, as next in the direction of movement there is situated at least one another pair of circular knives adjacent to each other or a unit comprising many pairs of circular knives adjacent to each other.

The apparatus according to the invention wherein the conveyor is a drum conveyor.

The apparatus according to the invention wherein the drum conveyor comprises two coaxially mounted drums, whereas the drum has the form of a ring and is attached to at least three rollers. The apparatus according to the invention is characterised in that the drum is driven by means of a gear wheel working with a gear ring situated inside the drum.

The apparatus according to the invention wherein the conveyor is a belt conveyor.

The apparatus according to the invention wherein at least partially in the area of overlapping of the adjacent circular knives the vacuum supplied to the flutes of the conveyor is reduced or cut off.

The apparatus according to the invention wherein at least partially in the area of overlapping of the adjacent circular knives and before that area the vacuum supplied to the flutes of the conveyor is reduced or cut off.

The object of the invention is also a method for processing tobacco industry's rod-like articles wherein the rod-like article is conveyed in the flute of the conveyor along a path of movement transverse to the axis of the rod-like article, the rod-like article is cut into two parts by means of two circular knives adjacent to each other, whereas the axes of such circular knives are situated on two sides of the path of movement, whereas the path of movement passes through an area of overlapping of the adjacent circular knives, while the axis of rotation of the circular knife is situated parallel to the axis of the rod-like article being cut.

The method according to the invention wherein the rod-like article is held by means of the vacuum supplied to the flute of the conveyor, and at the time of cutting the vacuum supplied to the flute is cut off or reduced, and after the end of the cutting process the vacuum supplied to the flute is turned on or increased.

The method according to the invention wherein the formed parts are cut by means of the circular knives not adjacent to other circular knives, whereas the axis of rotation of the circular knife is parallel to the axis of the rod-like article being cut.

In the apparatus for processing the rod-like articles according to the invention, it is possible to cut any rod-like articles of the tobacco industry, among others such articles in which there are situated inserts, for example metal plates being sections of a metal strip or made of plastics or other materials with a hardness greater than the material filling the rod-like article. At the moment of start of article cutting, the circular knives cut through the wrapping material and the filling material enclosing the insert. The resultant forces oppose each other and do not have any influence on the article's position. However, the forces generated by the circular knives when cutting a flat insert acting on the insert are greater than the force needed to cut the filling material, there is generated a torque which causes turning of the insert and the entire article at the same time. The use of the apparatus for rod-like articles having a flat insert inside causes that the articles are cut in uniform conditions, i.e. the article is turned so that the insert is positioned parallel to the path of movement of the rod-like article or at a small angle to the path. As a result, the variability of the process of cutting with two circular knives adjacent to each other was limited, and the cutting with knives not adjacent to other knives takes place at angular positions of the rod-like articles very similar for respective rod-like articles. The turning of the articles with an insert during the cutting process significantly contributes to an increase of the product quality because the inserts are less deformed after the cutting.

Furthermore, an unexpected effect of the uniform angular orientation of the rod-like articles after cutting by means of a circular knives unit in a shear configuration causes that further operations in the production process take place in more advantageous conditions, e.g. quality checking for rod-like articles with a consistent orientation is characterised by a greater measurement accuracy.

The object of the invention is described below in relation to embodiments demonstrated in a drawing in which FIG. 1 shows a fragment of a feeding module of an apparatus for cutting rod-like articles;

Figure 1:
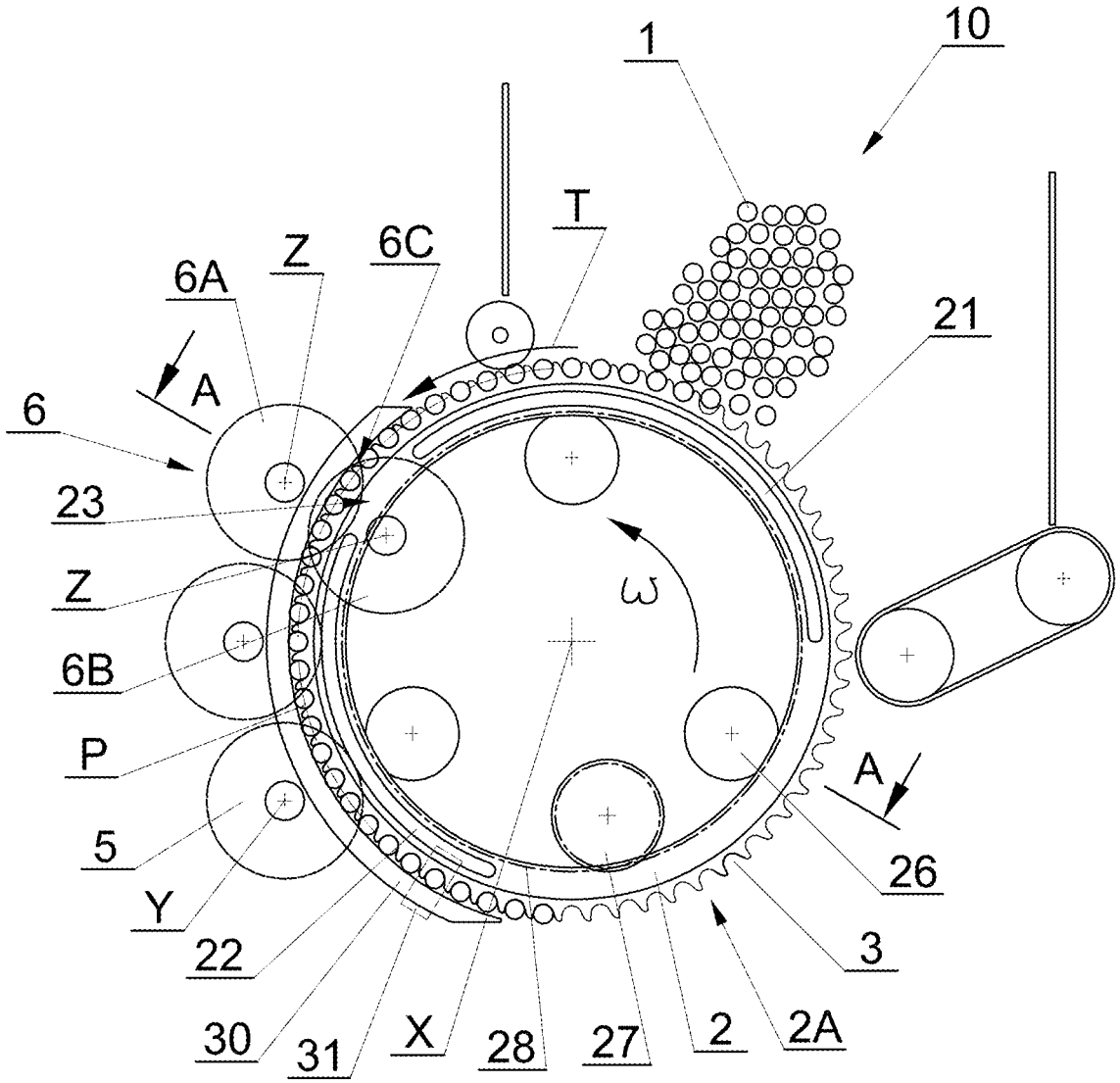

In the tobacco industry, machines for manufacturing multi-segment filter rods, among others for HnB (heat not burn) products, are commonly used. FIG. 1 shows a fragment of a feeding module of an apparatus for cutting rod-like articles. The rod-like articles should be characterised by a non-uniform (inhomogeneous) cuttability, whereas preferably the rod-like articles are subjected to a random preliminary orientation which causes that the non-uniform cuttability is asymmetrical to the axis determined as a straight line which is equidistant to the edges of the circular knives. Rods containing the filter material and/or auxiliary materials for manufacturing the segment rod, for example materials for manufacturing tobacco smoke channels, are supplied to the feeding module. In the HnB products, there are used segments filled with tobacco or tobacco foil having a centrally situated insert in the form of a steel plate. In the machine, the filter rods are subjected to processing, among others they are cut into segments which become components of a multi-segment rod. The feeding module comprises a hopper 10 for filter rods, generally for rod-like articles 1, whereas multi-segment rods may be fed to the hopper. Beneath the hopper 10, there is a drum conveyor 2 provided with flutes 3 on a cylindrical carrier surface 2A. The drum conveyor 2 is rotatably mounted at the axis X. The rod-like articles 1 are conveyed in the flutes 3 along a path of movement P which is transverse to the axis K of the rod-like article 1. Along the path of movement P, there are disposed circular knives for cutting the rod-like article 1, as first in the direction of movement T there is situated a pair 6 of circular knives comprising two circular knives 6A and 6B adjacent to each other, as second there is situated a circular knife 5 for cutting the parts 1A, 1B formed after cutting the rod-like article 1, whereas it is possible to situate two or more circular knives 5 at one axis of rotation Y. The axis of rotation Y of the circular knife 5 is parallel to the axis K of the parts 1A and 1B formed after cutting the rod-like article 1. Further in the direction of movement T, there may be placed further circular knives 5.

In the pair 6 of adjacent circular knives, the circular knife 6A is situated above the carrier surface 2A of the drum conveyor 2, whereas the circular knife 6B is situated beneath the carrier surface 2A. The circular knives 6A, 6B are disposed so that their axes of rotation Z, Z' are situated on two sides of the path of movement P shown also in FIG. 4. The circular knives 6A and 6B overlap and by rotating perform the shear-type cutting. The path of movement P passes through an area 6C of overlapping of the adjacent circular knives 6A, 6B. When conveyed in the flutes 3 the rod-like articles 1 are held in the flutes by means of vacuum supplied from the chambers 21 and 22, whereas the channels supplying the vacuum to the flutes 3 are not shown in the drawing. Within the whole or part of the area 6C of overlapping of the circular knives 6A, 6B, the vacuum is not supplied to the flutes 3. The area 23 of the lack of vacuum is situated between the chambers 21 and 22, the vacuum is not supplied to the flutes 3 at the moment of the start of cutting or before the start of cutting of the rod-like article 1. The lack of vacuum causes that the rod-like article 1 is not held in the flute during the cutting process or due to the time necessary for complete fading of the vacuum is held with a lesser force. In the area 23 between the chambers 21, 22, there may be used a chamber in which the vacuum has a smaller value, which will allow obtaining the effect of reduced force required to hold the rod-like article 1 in the flute 3 at least partially in the area 6C of overlapping of the circular knives 6A, 6B and/or before this area.

Figure 2:
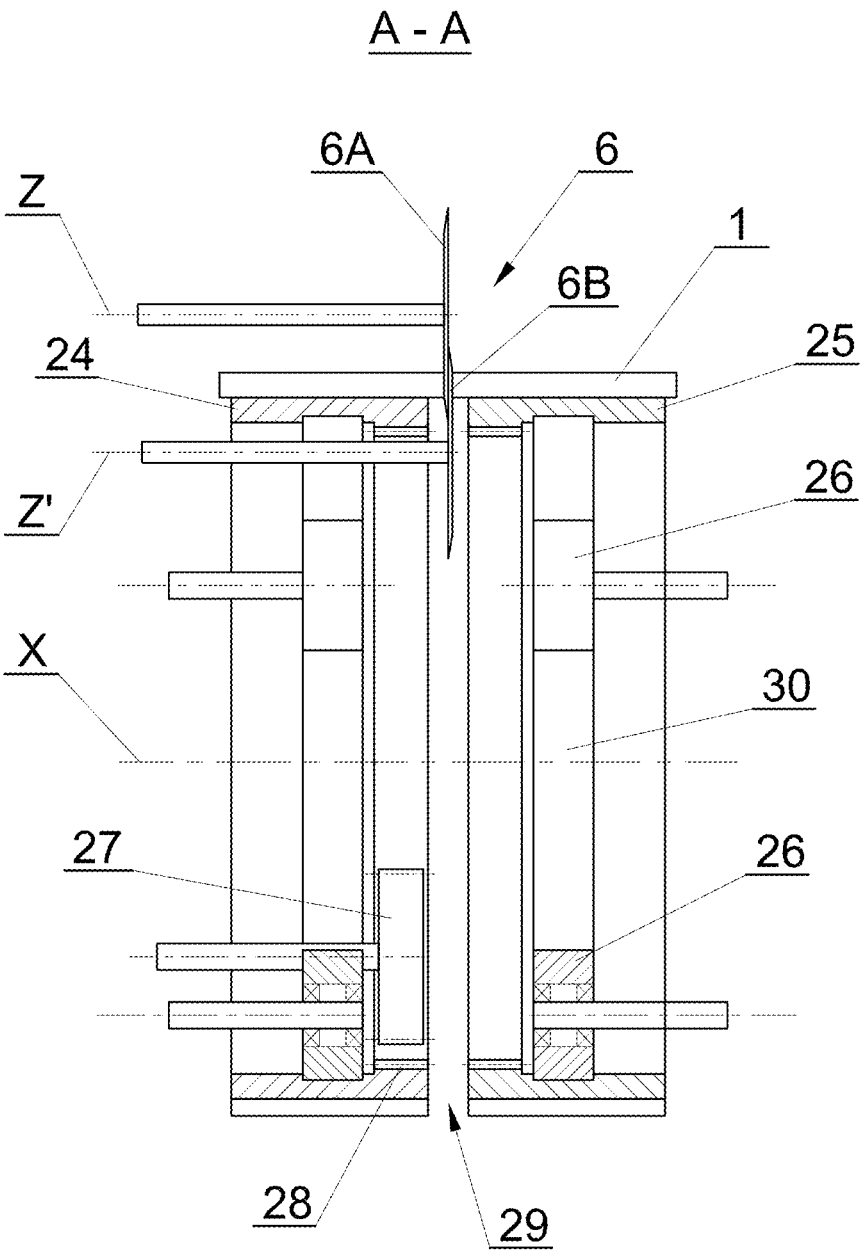
FIG. 2 shows an embodiment of a drum conveyor with two coaxial drums rotatably mounted at the axis X.

The drum conveyor 2 may be driven in any way. In the embodiment shown in FIG. 1 and FIG. 2, the drum conveyor 2 comprises two coaxial drums 24 and 25 rotatably mounted at the axis X. The drum 24, 25 has the form of a ring and is attached to at least three rotatable rollers 26 where the roller 26 operates with the groove 30, whereas one of the rollers 26 may be a driving roller. If the rollers 26 are used only as a bearing arrangement for the drum 24, 25, the drum may be driven by a gear wheel 27 operating with a gear ring 28 visible also in the cross-section A-A in FIG. 2. The pair 6 of circular knives 6A, 6B is situated in a gap 29 between the drums 24, 25.

Figure 3:
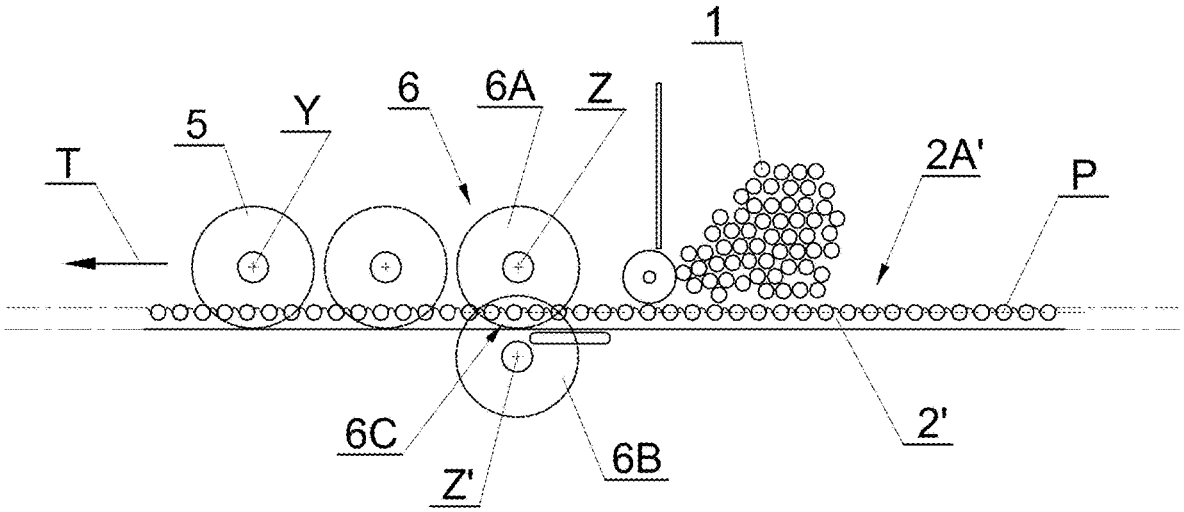
FIG. 3 shows an embodiment of a belt conveyor.

FIG. 3 shows an embodiment in which the belt conveyor 2' is used, whereas the circular knives are disposed in a similar way along the path of movement P as in the first embodiment. The axes of rotation Z, Z' of the circular knives 6A, 6B and the axes of rotation Y of the circular knives 5 are situated horizontally. Also possible is an embodiment of the apparatus for processing rod-like articles wherein the axes of rotation Z, Z' and Y are situated vertically and, in addition, the conveyor is adapted to hold the rod-like articles also vertically.

Figure 4:
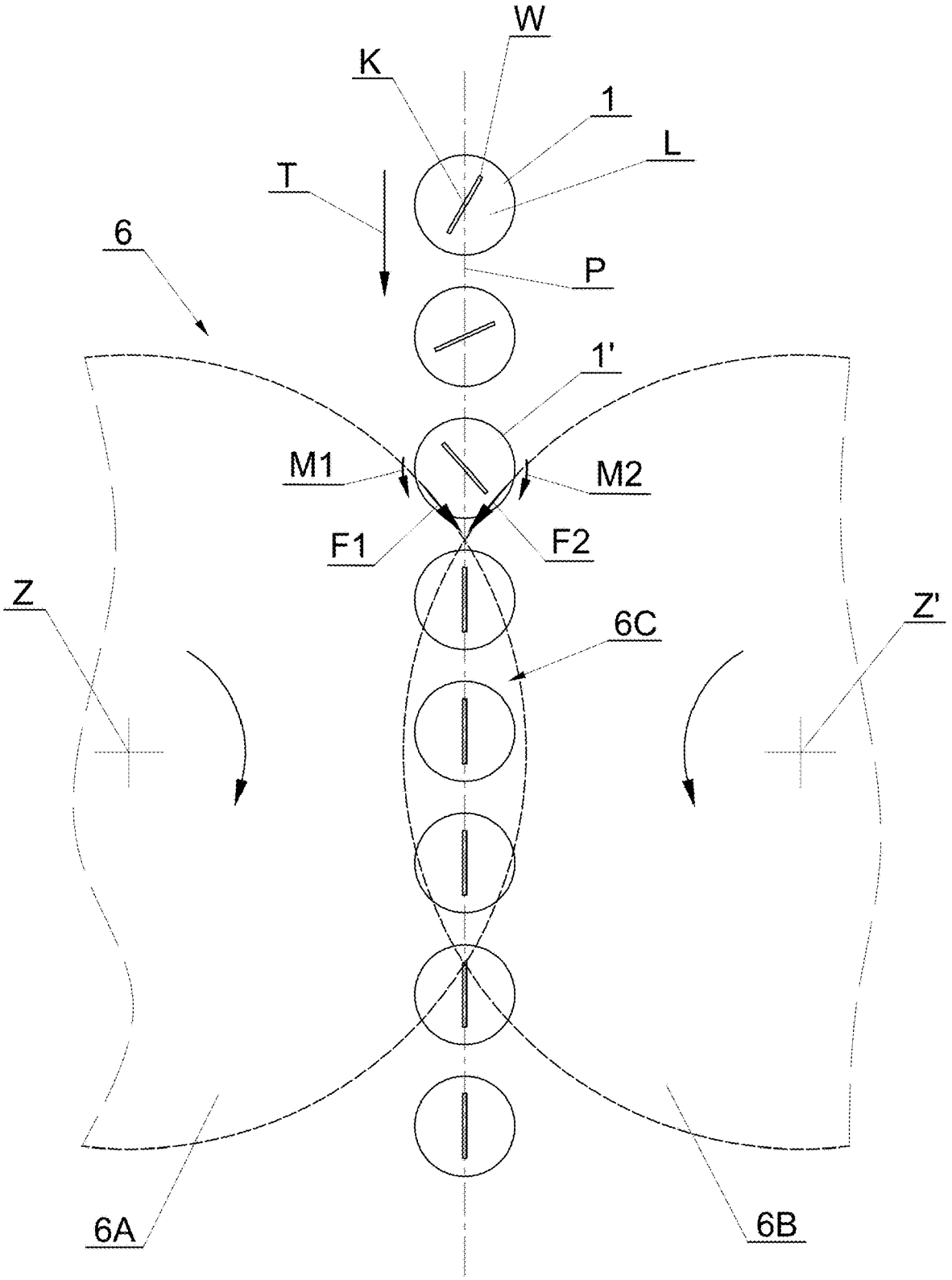
FIG. 4 shows an embodiment of a pair of circular knives at the moment of cutting a filling material in a view in the direction parallel to the axes of the knives.
Figure 5:
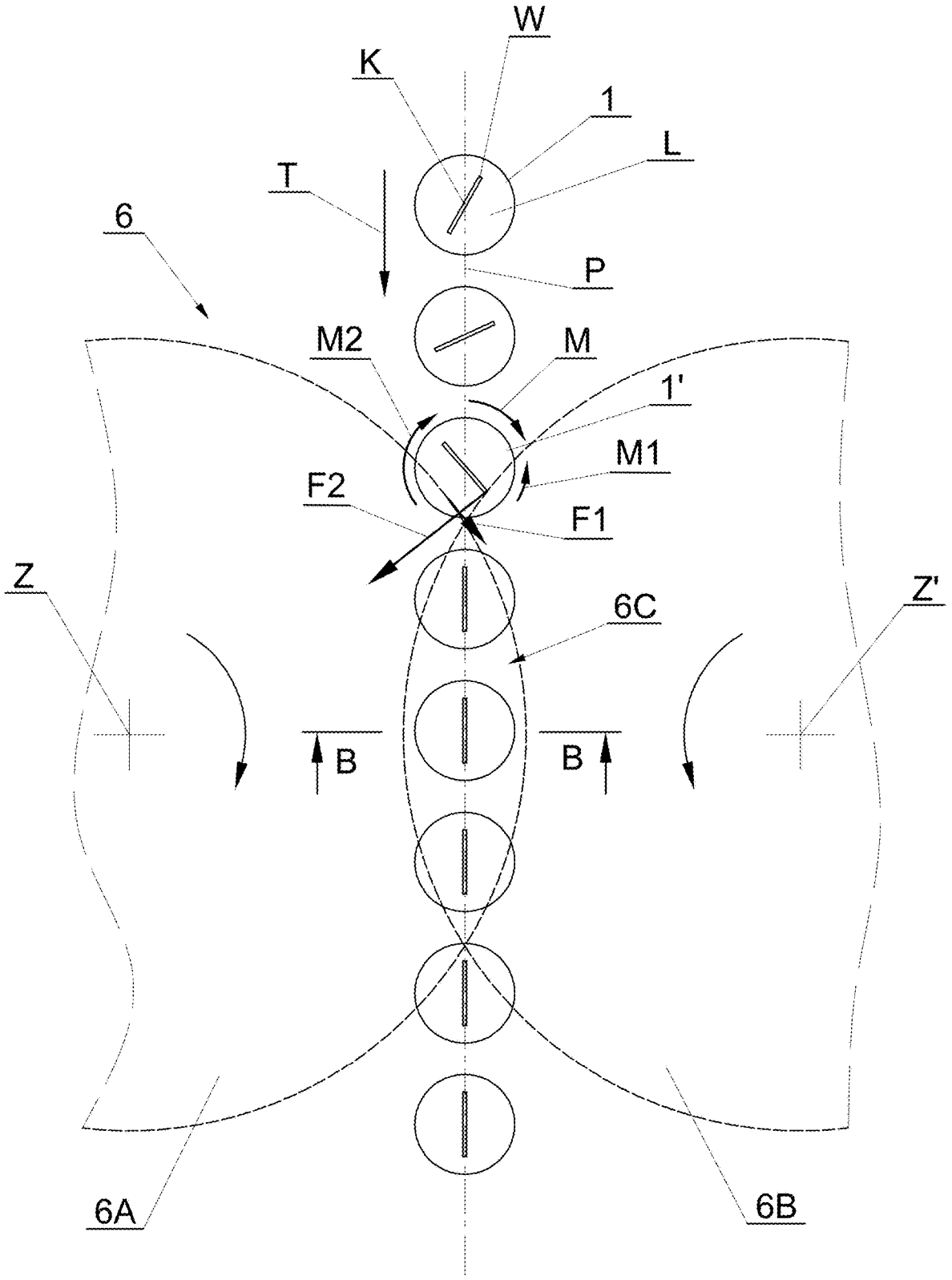
FIG. 5 shows an embodiment of the pair of circular knives of FIG. 4 at the moment of the start of cutting of an insert.
Figure 6:
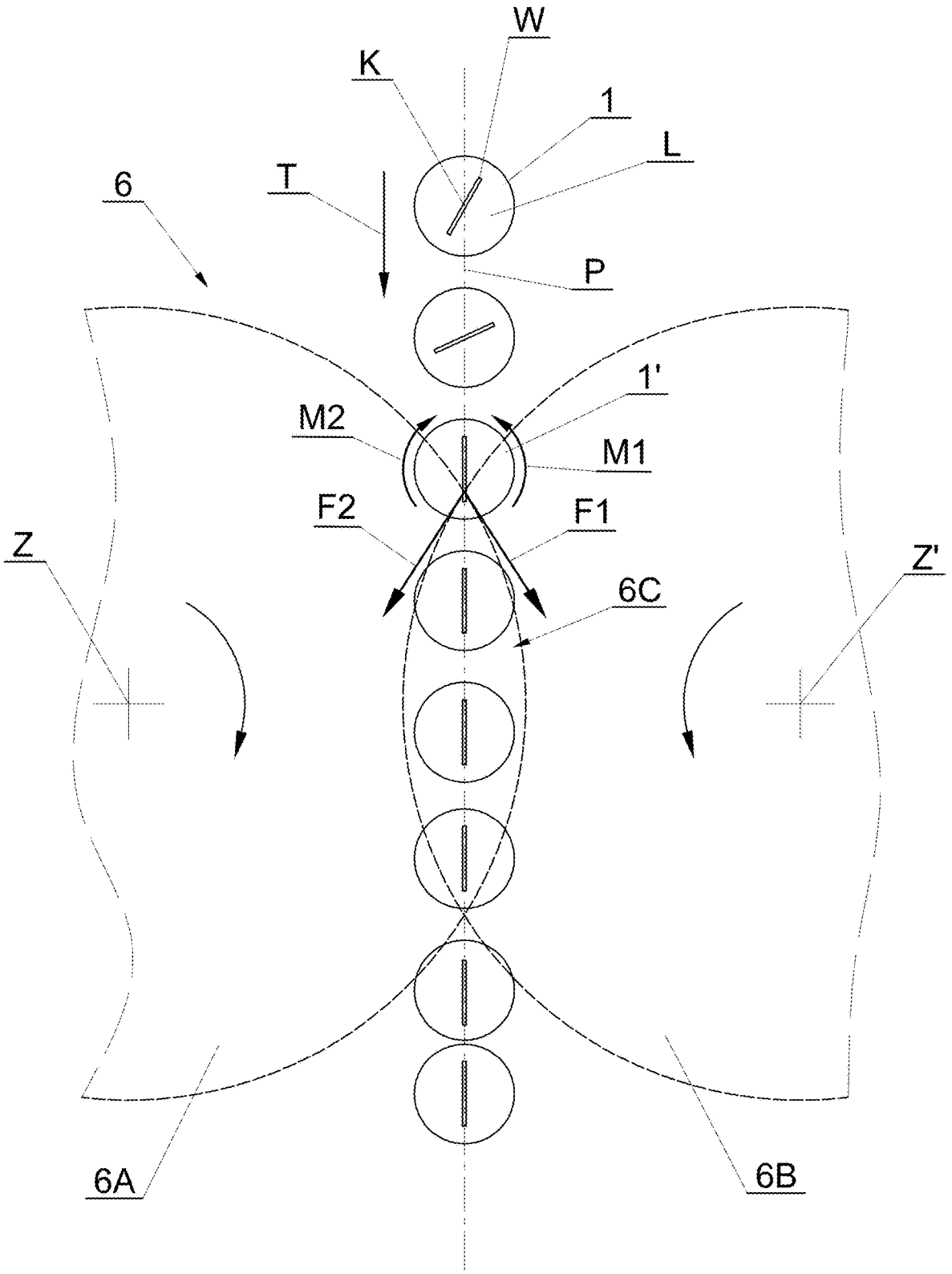
FIG. 6 shows an embodiment of the pair of circular knives of FIG. 4 at the moment of stopping of rotating rod-like article.

FIG. 4 shows the pair 6 of the circular knives 6A, 6B in a view in the direction parallel to the axis Z, for the sake of simplification, the path of movement P was shown as rectilinear. In the case of a rod-like article containing one kind of material the forces generated when cutting with the knives 6A, 6B exerted by the knives on the article 1 being cut will have the same value. FIG. 4 shows the rod-like article containing a flat insert W, whereas the subsequent rod-like articles 1 being fed are oriented in a random way. At the first cutting stage, the forces generated when cutting the filling material 1' have the same value. In the drawing, the force generated when cutting the filling material L, coming from the knife 6A, is marked as F1, the force with the same value, marked as F2, will be exerted on the rod-like article 1' by the knife 6B. The force F1 generates the torque M1 relative to the axis K of the rod-like article 1' in the anticlockwise direction, and the force F2 generates the torque M2 relative to the axis K of the rod-like article 1' in the clockwise direction, whereas the torques M1 and M2 have the same value, therefore the resultant torque produced by the cutting forces will be zero. At the moment when the knife 6B starts to cut the insert W as shown in FIG. 5, the force marked as F2, much greater than the force F1, is produced. The difference in value of the forces F1 and F2 results from the difference in the hardness (cuttability) between the insert material W and the filling material L of the rod-like article 1'. For the shown rod-like article 1' being cut, from the force F1 there is produced the torque M1 relative to the axis K of the rod-like article 1' in the anticlockwise direction, and from the force F2 there is produced the torque M2 in the clockwise direction. The resultant torque M acting on the rod-like article 1' in the clockwise direction will cause a rotation of the rod-like article 1'. The rod-like article 1' will rotate until the moment when the knife 6A comes into contact with the insert W, ultimately, the rod-like article 1' will cease to rotate when the insert W, in this article, is positioned substantially parallel or at a small angle to the path of movement P (FIG. 6). The insert W will not continue to turn the rod-like article 1' because the forces F1 and F2 have the same value. The torques M1 and M2 produced by the forces will also have the same value, the resultant torque equal to zero, thus the rod-like article 1' will not rotate. As a result of cutting with the circular knives 6A, 6B, the rod-like articles 1 containing the insert W will be cut in uniform conditions, i.e. in a uniform angular orientation because they will be positioned in a repeatable manner.

It needs to be mentioned that the cutting of the rod-like articles with a uniform cuttability by means of the pair of circular knives (6A, 6B) in a circular arrangement does not automatically cause rotation of the rod-like article. The rod-like articles may be provided with inserts of various kinds, whereas their cuttability is different from the filling material's cuttability. For example, the rod-like article made of tobacco may contain a metal insert for tobacco heating, and the rod-like article constituting the filter part may contain an identification wire. The non-uniform cuttability in the cutting plane leads to the occurrence of a non-zero torque, as a result of which rotation of the rod-like article at the time of cutting may be obtained. As mentioned above, the non-uniform cuttability may be caused by placing an insert with physical properties which are different from the filling's properties, but it may also result from the use of different filling materials distributed lengthwise inside the rod-like article.

A necessary condition for the abovementioned rotation of the rod-like article at the time of cutting is holding the insert in a manner allowing its rotation, i.e. for example in horizontal arrangements of band conveyors it is sufficient to hold the rod-like article in the flute using the force of gravitation, whereas in drum conveyors vacuum is used. In the latter case, the vacuum needs to be reduced or cut off at the time of cutting and turning, which enables the torque to overcome the forces of friction and to turn the article until the moment of equalization of forces coming from the knives and fading of the torque.

Figure 7:
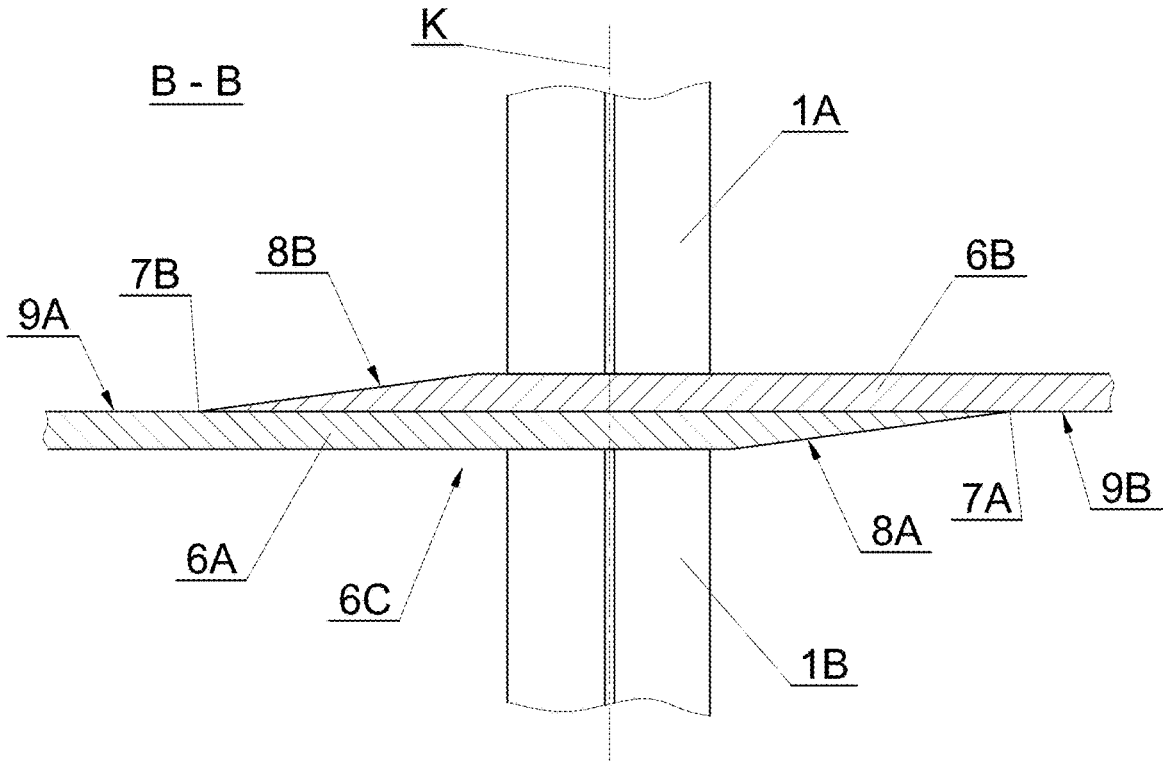
FIG. 7 shows an embodiment of the pair of circular knives in the cross-section B-B of FIG. 5.

As shown in the cross-section B-B in FIG. 7 (marked in FIG. 5), in the pair 6 of the adjacent knives 6A, 6B the cutting edge 7A, 7B of the circular knife 6A, 6B is formed by the lateral surface 9A, 9B of the circular knife 6A, 6B and the circumferential conical surface 8A, 8B. As can be seen, in the pair 6 of the adjacent circular knives 6A, 6B the cutting edge 7A, 7B of one circular knife 6A, 6B is situated adjacently to the other circular knife 6A, 6B. The parts 1A, 1B formed as a result of cutting with the circular knives 6A, 6B will be further conveyed in the flutes 3 for cutting with the circular knives 5. Such arrangement of the circular knives is referred to as shear-type arrangement due to the nature of the cutting process which corresponds to the operations of shears.

Figure 8:
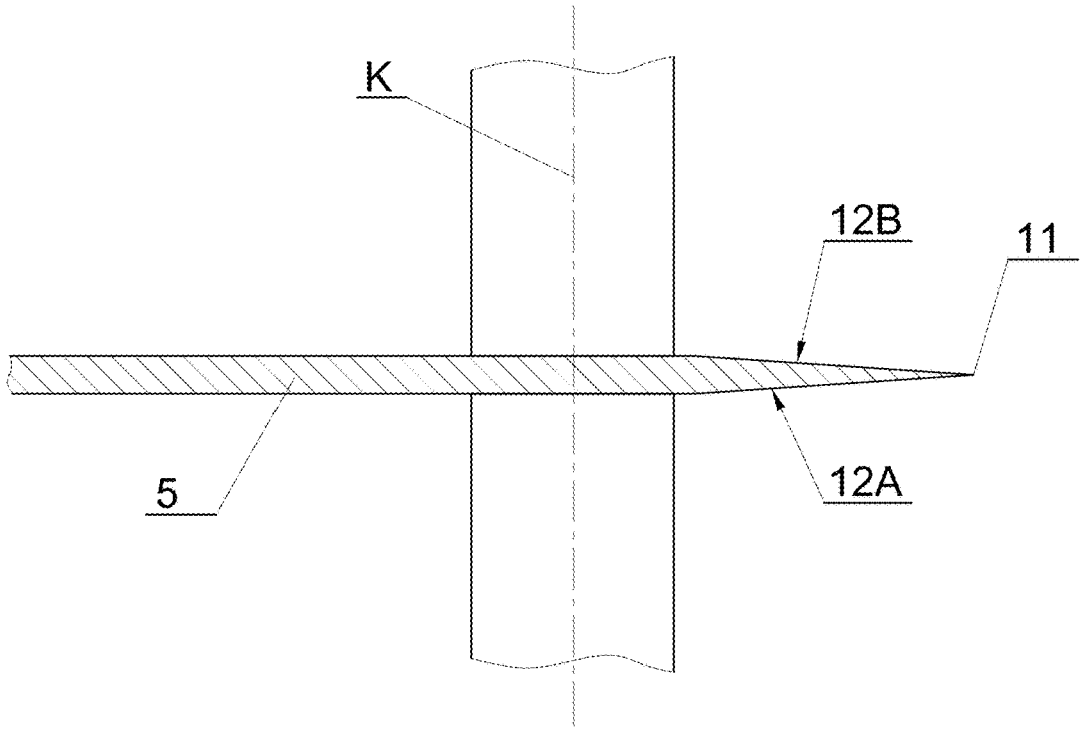
FIG. 8 shows a cross-section through a single circular knife.

FIG. 8 shows a cross-section of the circular knife 5, whereas he cutting edge 11 of the circular knife 5 not adjacent to another circular knife is formed by two conical surfaces 12A, 12B.

The rod-like article 1 is conveyed along the path of movement P in the flute 3 of the drum conveyor 2 in which it is held by means of vacuum, at the time of momentary pressure drop in the area 6C of overlapping of the adjacent circular knives 6A, 6B, the rod-like article 1 is cut into two parts 1A, 1B. It is possible to hold the rod-like article 1 by means of a jacket 30 situated above the carrier surface 2A. After cutting the rod-like article 1, the formed parts 1A, 1B are held by vacuum at the time of further operations of cutting with the circular knives 5, whereas the parts being cut are further conveyed along the path P situated above the carrier surface 2A of the drum conveyor 2. The axes of the rod-like article 1, the parts 1A, 1B and the segments formed by further cutting operations are situated perpendicular to the path of movement P. According to the disclosure of this invention, the rod-like article 1 is to be cut by means of the adjacent circular knives 6A, 6B, and further cutting operations (i.e. a further process steps) are to be done by means of single knives 5 (knives not adjacent to other knives), whereas it is possible to use the pairs 6 of adjacent circular knives in all cutting operations, what is described below. The axes Y of the single circular knives 5 as well the axes Z, Z' of the circular knives 6A, 6B are situated parallel to the axis of rotation of the drum conveyor 2. Usually in the second cutting operation, each of resulting parts 1A, 1B is further cut into two shorter parts by the two circular knives 5, with their axes overlapping. Overlapping of axes is applied in the next cutting operations.

Figure 9:
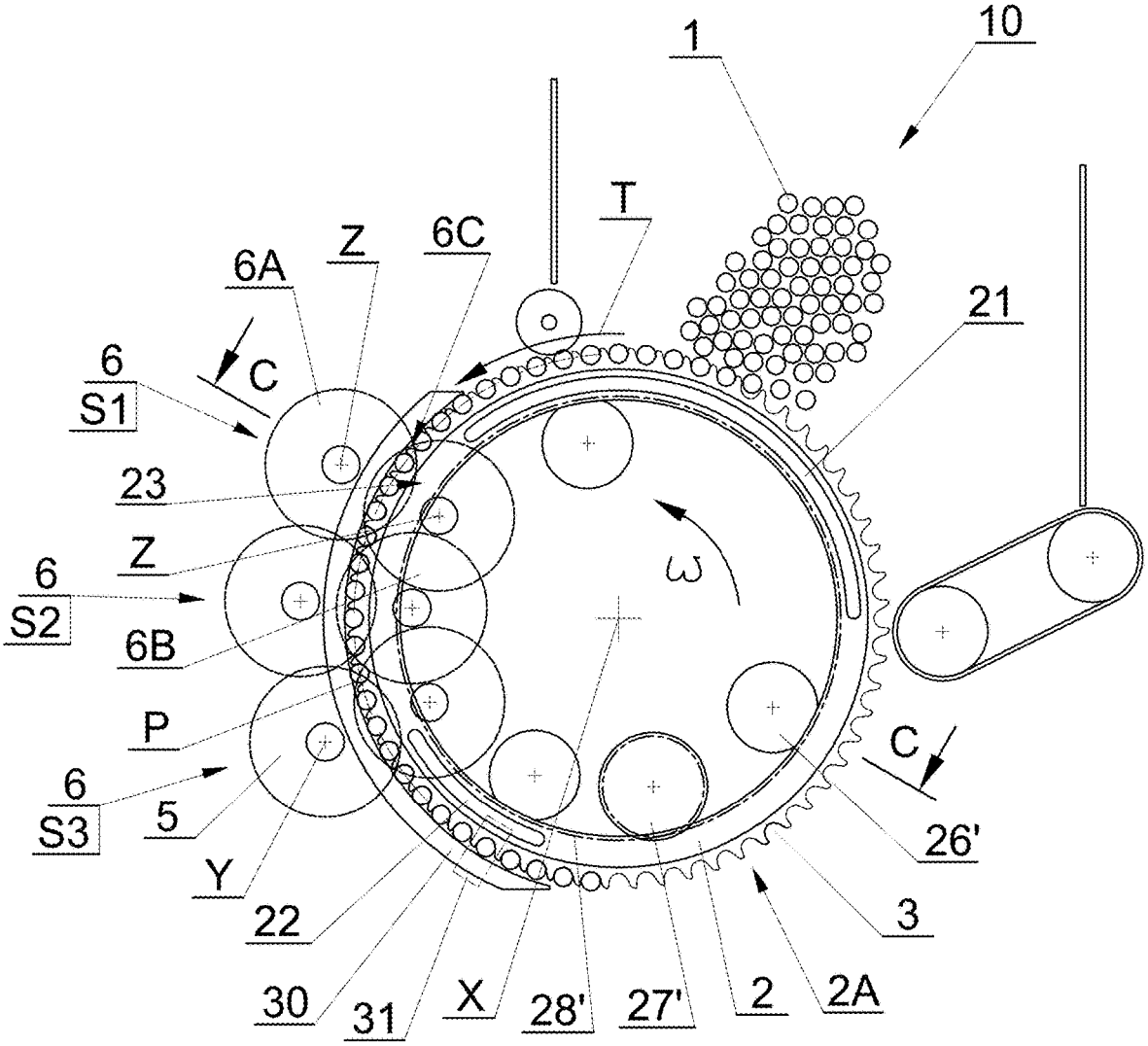
FIG. 9 shows an embodiment of the invention with multiple pairs of circular knives.
Figure 10:
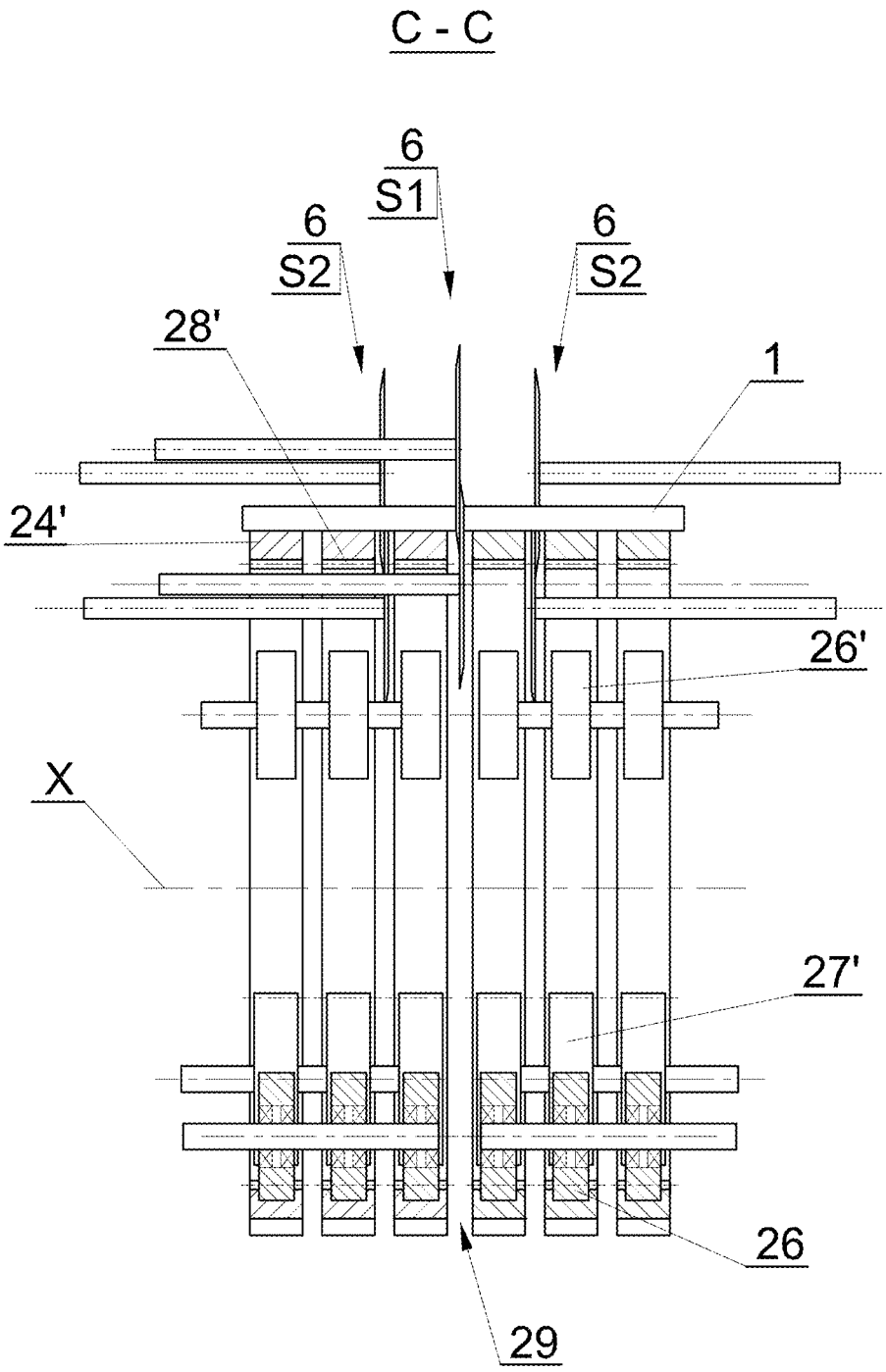
FIG. 10 shows a cross section of the embodiment of FIG. 9.

In one of the possible embodiments of the invention, where the rod-like articles 1 are cut into many parts, in which in the first cutting operation in the path of movement P, there is at least one cut made by the pair 6 of the circular knives 6A, 6B. In the embodiment shown in the FIG. 9 rod-like article 1 is cut in three steps, i.e. at least three pairs 8 of circular knives are used in the subsequent cutting operations S1, S2, S3. By analogy as for circular knives 5 in a single cutting operation at the same axis there might be positioned circular knives 6A, 6B in the pairs 6 for the subsequent cutting operations. An apparatus adopted for several cutting operations is provided with several drums, which convey respective parts of the rod-like article 1. In the cross-section C-C shown in the FIG. 10 there is six drums 24' in a form of rings, and in between drums 24' there are spacings 29. There are shown pairs 6 of the circular knives 6A, 6B for the first cutting operation S1 and for the second cutting operation S2, to maintain clarity the pairs 6 of the circular knives for the cutting operation S3 are not shown as they involve two or three pairs 6 of circular knives 6*a*, 6B. For example in a case of cutting a rod-like article 1 into twelve segments it shall be used a set of eleven pairs 6 of knives and twelve drums 24'. Analogically to the previous embodiment the drum 24' can be mounted rotatably on the rollers 26' and can be driven by a sprocket or gear 27' cooperating with a toothed wreath 28'.

In another embodiment, along the path of movement P there is situated a quality check station arranged to check the quality of the rod-like articles 1 or the rod-like articles cut into the parts 1A and 1B. The quality checking station is marked in FIG. 1 as 31. Such station operates in the range of visible, infrared, ultraviolet radiation or in the range of X-ray waves. Preferably, the quality check is combined with the function of tracking of the position of defective rod-like articles for the purpose of subsequent rejection of such defective articles. Preferably, after cutting the rod-like articles according to the invention, it is possible to apply further cutting by means of the circular knives followed also by the quality check of the cut rod-like articles.

The invention claimed is:

1. An apparatus for processing rod-like articles of the tobacco industry, the apparatus comprising a conveyor, wherein the rod-like articles are conveyed in flutes of the conveyor along a path of movement transverse to the axis of the rod-like article, the apparatus provided with a pair (6) of circular knives (6A, 6B) adjacent to each other, whereas the axes of rotation (Z, Z') of the circular knives are situated on two sides of the path of movement (P), characterized in that the path of movement (P) passes through an area (6C) of overlapping of the adjacent circular knives (6A, 6B), whereas in the pair (6) of the adjacent circular knives (6A, 6B) one circular knife (6A) is situated above the carrier surface (2A, 2A') of the conveyor (2, 2'), whereas the other circular knife (6B) is situated beneath the carrier surface (2A, 2A') of the conveyor (2, 2'), wherein in the pair (6) of the adjacent knives (6A, 6B) a cutting edge (7A, 7B) of the circular knife (6A, 6B) is formed by a lateral surface (9A, 9B) of the circular knife (6A, 6B) and a circumferential conical surface (8A, 8B).

2. The apparatus as in claim 1, wherein in the pair (6) of the adjacent circular knives (6A, 6B) the cutting edge (7A, 7B) of one circular knife (6A, 6B) is situated adjacently to the lateral surface (9A, 9B) of the other circular knife (6A, 6B).

3. The apparatus as in claim 1, wherein the apparatus is provided with at least one circular knife (5) not adjacent to another circular knife for cutting a rod-like article, whereas the axis of rotation (Y) of the circular knife (5) is parallel to the axis (K) of the rod-like article being cut, and the cutting edge (11) of the circular knife (5) not adjacent to another circular knife is formed by two conical surfaces (12A, 12B).

4. The apparatus as in claim 1, wherein on the path of movement (P) of the rod-like articles (1) as first in the direction of movement (T) of the rod-like articles (1) there is situated the pair (6) of the circular knives (6A, 6B) adjacent to each other, as next there are situated the circular knives (5) not adjacent to other circular knives.

5. The apparatus as in claim 1, wherein in the path of movement (P) of rod-like articles (1) as the first in the direction of travel (T) of rod-like articles (1) there is a pair (6) of circular knives (6A, 6B) adjacent to each other, and further in the path of movement there is at least one yet another pair (6) of circular knives (6A, 6B) adjacent to each other or a unit comprising many pairs of circular knives (6A, 6B) adjacent to each other.

6. The apparatus as in claim 1, wherein the conveyor (2) is a drum conveyor.

7. The apparatus as in claim 6, wherein the drum conveyor (2) comprises two coaxially mounted drums (24, 25), whereas the drum (24, 25) has the form of a ring and is mounted by means of at least three rollers (26).

8. The apparatus as in claim 7, wherein the drum (24, 25) is driven by means of a gear wheel (27) operating with a gear ring (28) situated inside the drum (24, 25).

9. The apparatus as in claim 1, wherein the conveyor (2') is a belt conveyor.

10. The apparatus as in claim 6, wherein at least partially in the area of overlapping (6C) of the adjacent circular knives (6A, 6B) the vacuum supplied to the flutes (3) of the conveyor (2, 2') is reduced or cut off.

11. A method for processing rod-like articles (1) of the tobacco industry wherein the rod-like article (1) is conveyed in a flute (3) of the conveyor (2, 2') along a path of movement (P) transverse to the axis (K) of the rod-like article (1), the rod-like article (1) is cut into two parts (1A,1B) by means of two circular knives (6A, 6B) adjacent to each other, whereas the axes (Z, Z') of the circular knives are situated on two sides of the path of movement (P), whereas the path of movement (P) passes through an area of overlapping (6C) of the adjacent circular knives (6A, 6B), while the axis of rotation (Z, Z') of the circular knife (6A, 6B) is situated parallel to the axis (K) of the rod-like article (1) being cut.

12. The method as in claim 11, wherein the rod-like article (1) is held by means of vacuum supplied to the flute (3) of the conveyor (2, 2'), and at the time of cutting the vacuum supplied to the flute (3) is reduced or cut off, and after the end of the cutting process the vacuum supplied to the flute (3) is turned on or increased.

13. The method as in claim 11, wherein the formed parts (1A, 1B) are cut by means of circular knives (5) not adjacent to other circular knives, whereas the axis of rotation (Y) of the circular knife (5) is parallel to the axis (K) of the rod-like article (1) being cut.

* * * * *